US011400569B2

(12) United States Patent
Hsieh

(10) Patent No.: US 11,400,569 B2
(45) Date of Patent: Aug. 2, 2022

(54) TORQUE TOOL WITH SEGMENTED WARNING EFFECT

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 482 days.

(21) Appl. No.: 16/656,683

(22) Filed: Oct. 18, 2019

(65) Prior Publication Data

US 2020/0180126 A1 Jun. 11, 2020

(30) Foreign Application Priority Data

Dec. 6, 2018 (TW) ..... 107143978

(51) Int. Cl.
*B25B 23/00* (2006.01)
*B25B 23/142* (2006.01)

(52) U.S. Cl.
CPC ..... *B25B 23/1425* (2013.01)

(58) Field of Classification Search
CPC ..... B25B 23/1425; B25B 23/00; B25B 25/00
See application file for complete search history.

(56) References Cited

U.S. PATENT DOCUMENTS

| | | | | |
|---|---|---|---|---|
| 8,485,075 | B1 * | 7/2013 | Gauthier | B25B 23/1425 81/479 |
| 2011/0132158 | A1 * | 6/2011 | Wener | B25B 23/1427 81/479 |
| 2020/0180126 | A1 * | 6/2020 | Hsieh | B25B 23/1425 |
| 2020/0180127 | A1 * | 6/2020 | Hsieh | B25B 23/1425 |

* cited by examiner

*Primary Examiner* — Lee D Wilson
(74) *Attorney, Agent, or Firm* — Guice Patents PLLC

(57) ABSTRACT

A torque tool with a segmented warning effect includes: a tool body having a sensing unit, a processing unit for receiving a sensed value of the sensing unit and comparing the sensed value with a predetermined value to output a comparison value; at least two warning intervals formed by the comparison value of at least two different warning ranges; a warning assembly for providing warning by a primary warning unit and at least one secondary warning unit; the primary warning unit uses at least two colors for different warning intervals, and at least two illuminators of each secondary warning unit to warn at least two stages, the primary warning unit provides a primary warning for the warning interval, and the secondary warning unit at each warning interval forms secondary warnings to let users know about the operating torque quickly.

13 Claims, 6 Drawing Sheets

TORQUE TOOL WITH SEGMENTED WARNING EFFECT

BACKGROUND OF INVENTION

1. Field of the Invention

The present invention relates to a warning device of a torque tool, in particular to the torque tool that provides a warning composed of a primary warning and a secondary warning in each warning interval to make the warning easy-to-read and accurate.

2. Description of the Related Art

To indicate a torque value of an electronic torque tool and let users know about the condition of applying a torque, an indicator screen is generally used to provide a numerical indication. However, the way of indicating the torque value by the numerical indication has a drawback, that the user is distracted to watch the indicator screen while operating the tool, and such operation is inconvenient and may even be dangerous in some actual practices. To give an auxiliary indication effect, a conventional electronic torque wrench with an illuminator is provided for the torque warning, so that the users can roughly know the value of the current applied torque and the ratio of the applied torque value to the predetermined torque value by a change of the illuminator.

There are two common methods of providing warnings by the illuminator. One of the methods is an interval indication, wherein different color light indications are produced within different predetermined percentage ranges. For example, a green light indication is given when the comparison value falls within a range of 0~40%, and a yellow light indication is given when the comparison value falls within a range of 41%~70%, and a red light indication is given when the comparison value is 71% or above, so that the different color lights allow users to know the percentage range of the current torque value. The other method is to use a plurality of illuminators (such as ten illuminators), wherein one more illuminator will be lit when the torque of the torque tool is increased by every 10%, so that the users can roughly know about the percentage of the current torque value by the number of lit illuminators.

In the aforementioned methods of providing warnings through the illuminators, if a change of colors is the only way for indicating the interval values, the percentage range of the interval indication will be relatively larger. For example, the percentage falling within the range from 71% to 100% is indicated by a red color, and the users are unable to know whether or not the target has reached the desired target value while controlling the torque due to insufficient precision, and the users are also unable to determine whether to continue applying the force or stop applying the force to the torque tool. Therefore, the tool or components may be damaged easily when the applied force is too large or the workpiece cannot be fixed securely when the applied force is insufficient. In the method of using a different number of illuminators to indicate the torque value, each illuminator represents the percentage of a small range. Although the indication of the torque value is more accurate, yet the number of illuminators is relatively large, and the users have to confirm the number of illuminators in order to confirm the percentage of the applied force, and thus this method is inconvenient. Particularly, if the size of the illuminator is small, it will be not easy for the users to check the number of illuminators. Obviously, the indication given by too many illuminators relatively reduces the convenience of providing the torque warning.

SUMMARY OF THE INVENTION

An objective of the present invention is to provide a torque tool having a segmented warning to indicate a torque value, also provide small and easy-to-read warning intervals to allow users to determine an operation value quickly and accurately.

Another objective of the present invention is to provide the torque tool with a segmented warning of the torque value, and the torque tool forms a warning by using a primary warning and a secondary warning to facilitate users to determine the range of the torque value accurately during the operation.

To achieve the aforementioned objectives, the present invention provides a torque tool with a segmented warning effect, comprising:

a tool body having a sensing unit for sensing an operation value of the torque tool to form a sensed value;

a processing unit for comparing the sensed value of the sensing unit with a predetermined value and outputting a comparison value;

at least two warning intervals formed by the comparison value of at least two different numerical ranges;

a warning assembly having a primary warning unit and at least one secondary warning unit, the primary warning unit having at least two luminescent colors, and said secondary warning unit having at least two illuminators;

wherein the warning assembly providing a warning in each warning interval together with the primary warning unit and the secondary warning unit, when the comparison value falls in one of the warning intervals, the primary warning unit emitting a color light; the at least two illuminators of the secondary warning unit correspond to the secondary warning of at least two stages to form a staged light warning; and when the comparison value falls into a different warning interval, the primary warning unit will emit a different color light.

Preferably, the sensing unit is capable of sensing at least one operation value such as a torque value or an angle measured during the operation of the torque tool.

Preferably, the secondary warning unit has the quantity of lighting increasing with the operation value.

The torque tool with a segmented warning effect of the present invention forms a warning of a warning interval by using the primary warning unit and the secondary warning unit, the secondary warning units can provide a staged secondary warning within the warning interval to let users know about the ratio of the current operation value to the predetermined value quickly and accurately.

BRIEF DESCRIPTION OF THE DRAWINGS

The present invention will become clearer in light of the following detailed description of an illustrative embodiment of this invention described in connection with the drawings, so that people having ordinary skill in the art can implement the present invention according to the description of this specification.

DESCRIPTION OF THE PREFERRED EMBODIMENTS

Figure 1:
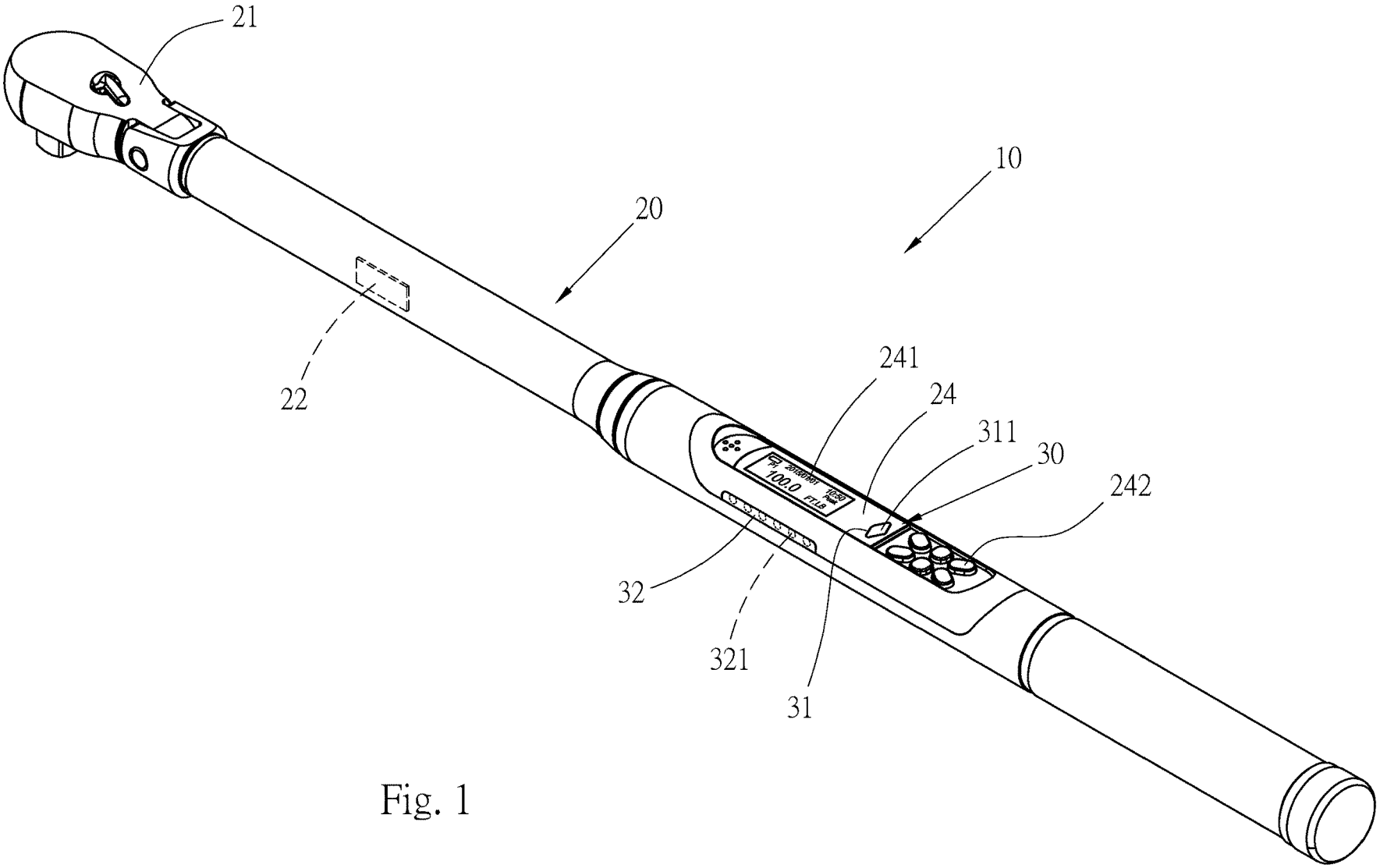
FIG. 1 is a perspective view of a torque tool in accordance with a preferred embodiment of the present invention.
Figure 2:
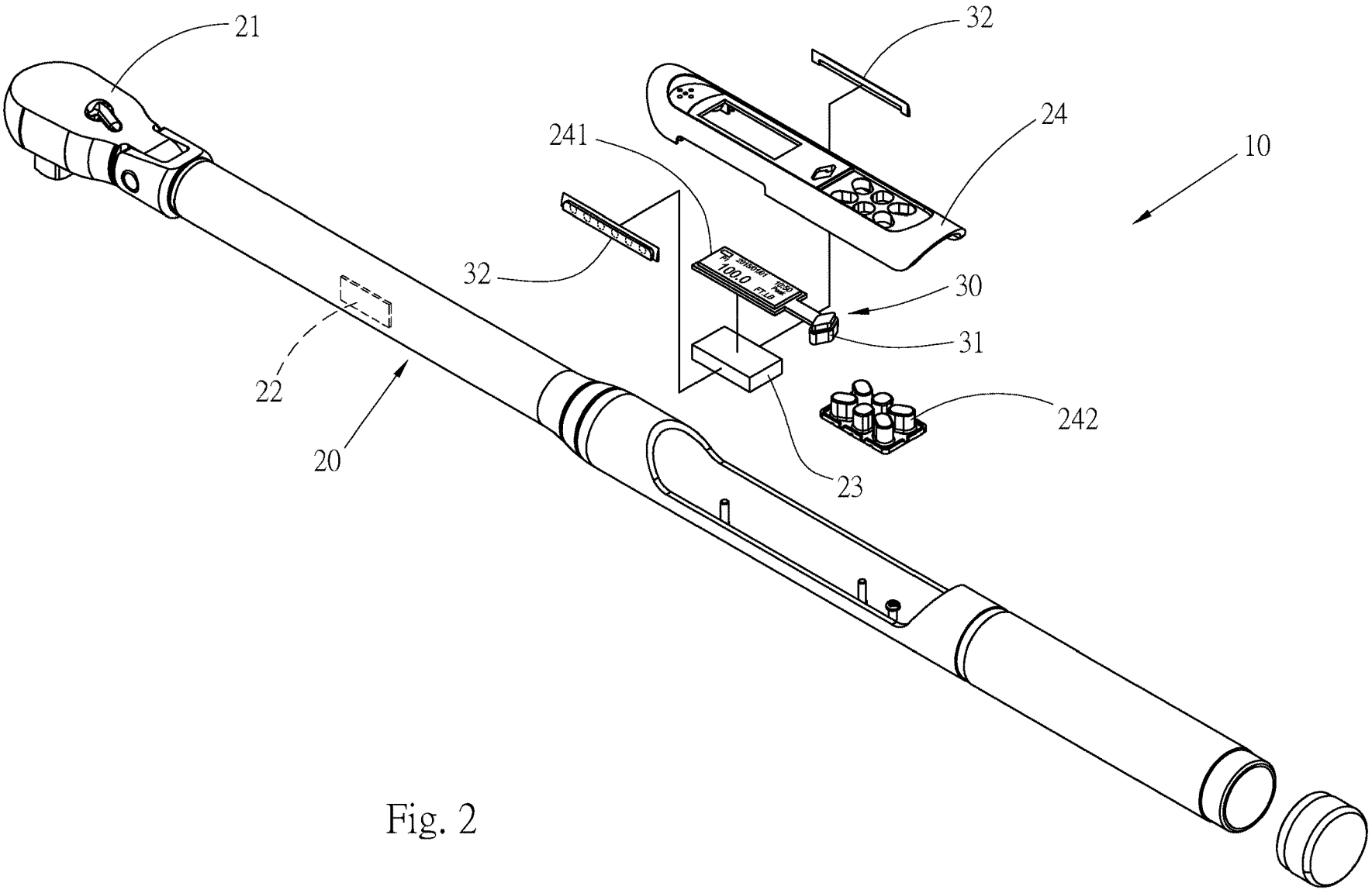
FIG. 2 is an exploded view of a torque tool in accordance with a preferred embodiment of the present invention.

With reference to FIGS. 1 and 2 for a torque tool in accordance with a preferred embodiment of the present invention, the torque tool 10 is an electronic torque tool having a tool body 20, a tool head 21 disposed at a front end of the tool body 20, a handle disposed at a rear end of the tool body 20 for users to hold the torque tool 10. The tool body 20 can be applied a force to the tool head 21 to perform a loosening or tightening task. The tool body 20 has a sensing unit 22 provided for sensing and measuring the value of a torque produced by the operation of the tool body 20. The tool body 20 has a processing unit 23 for receiving the torque value sensed and measured by the sensing unit 22. The processing unit 23 has an adjustable predetermined value, wherein the predetermined value may be a torque value, an angle (or a rotational angle of the torque tool) or an angle value of the rotational angle after the applied force value has reached the predetermined torque value (Hereinafter referred to as angle measured after reaching predetermined torque value).

The tool body 20 has a panel 24, the panel 24 has a display screen 241 and a button module 242. The display screen 241 is provided for displaying information such as the sensed value measured by the sensing unit 22 or the predetermined value set for the torque tool and display different information such as the date, time, level of power, unit of the torque value, etc. The button module 242 is provided for controlling and selecting related options and operations. In an operation, after the sensed value (such as the torque value and angle value) measured by the sensing unit 22 is compared with the predetermined value of the processing unit 23, the processing unit 23 will compute the compared result to produce a comparison value in terms of percentage (sensed value/predetermined value x %). In this preferred embodiment, the range of the comparison value is divided into three warning intervals, and each warning interval is subdivided into secondary warnings of three stages.

A warning assembly 30 has a primary warning unit 31 and two set secondary warning units 32, wherein the primary warning unit 31 is installed at a central position of the panel 24. In other words, the primary warning unit 31 is disposed at the front of the tool body 20 and between the display screen 241 and the button module 242. The secondary warning units 32 are installed at positions on both sides of the tool body 20 and proximate to the panel 24 respectively. The primary warning unit 31 can emit light and provides warnings with three different colors corresponding to three different warning intervals (such as a low-level warning interval, a mid-level warning interval, and a high-level warning interval), and the secondary warning unit 32 can give warnings with respect to the secondary warning of the three stages in each warning interval.

In the present invention, each warning interval is warned by using the primary warning unit 31 and the secondary warning units 32, wherein the primary warning unit 31 provides a rough warning to users, the secondary warning units 32 provides segmented warnings for each warning interval, the warning interval of the primary warning unit 31 may be subdivided by the secondary warning unit 32 into secondary warnings of three stages, so as to allow users to receive the warning of each warning interval more accurately through the cumulative warning effect of the secondary warnings of three stages. In addition, there are only three secondary warning units 32, so that the users can read and recognize the warning quickly.

Figure 3:
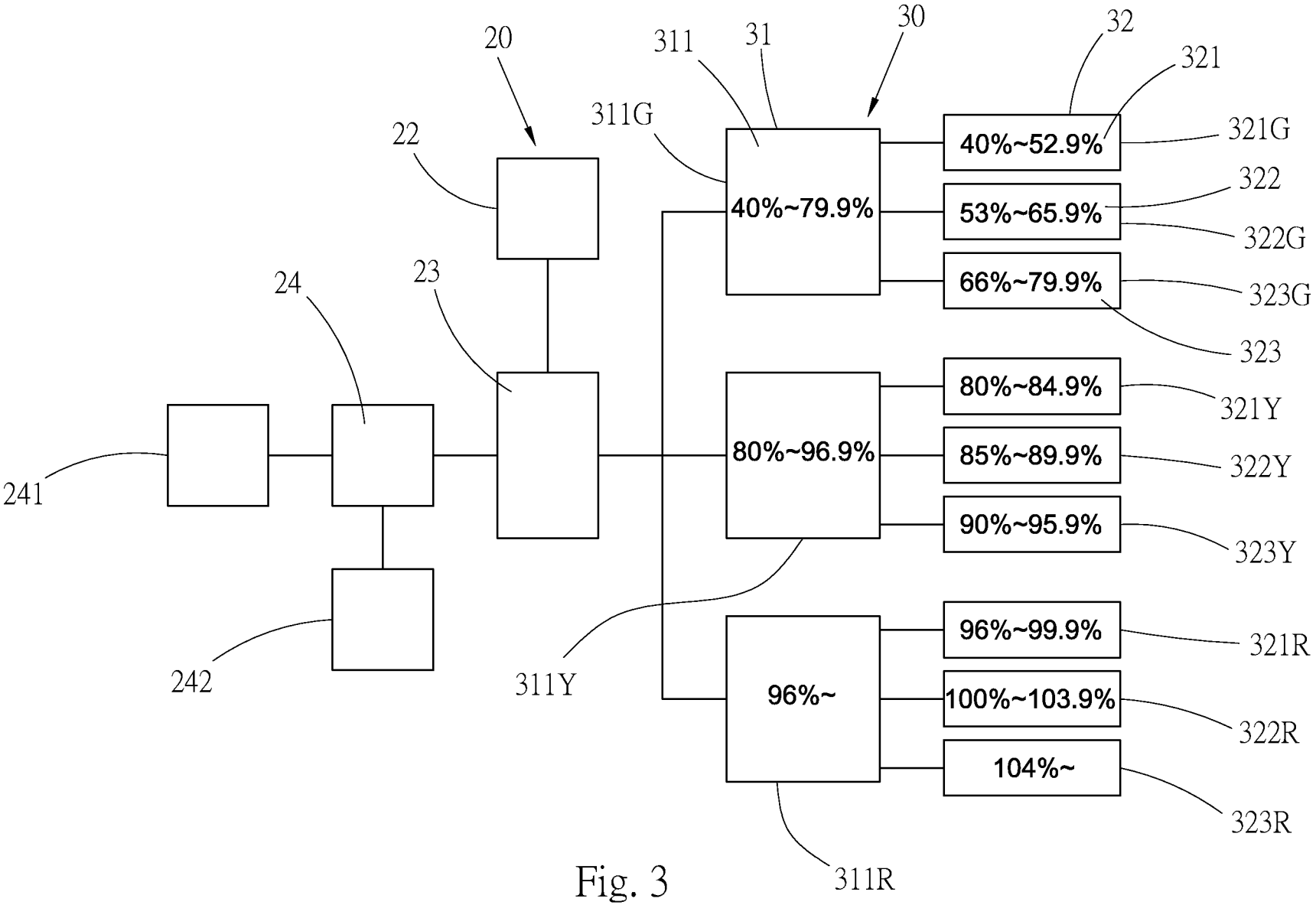
FIG. 3 is a schematic view of showing a percentage distribution of a warning assembly in accordance with a preferred embodiment of the present invention.

Please refer to FIG. 3, the three different warning intervals of this preferred embodiment include a low-level warning interval, a mid-level warning interval, and a high-level warning interval. In the comparison values relative to three different numerical ranges, the comparison value of the low-level warning interval has a predetermined percentage of 40%~79.9%, the comparison value of the mid-level warning interval has a predetermined percentage of 80%~95.9%, and the comparison value of the high-level warning interval has a predetermined percentage over 96%.

In this embodiment, each warning interval is subdivided into secondary warnings of three stages. In detail, the secondary warnings of three stages are distributed in the low-level warning interval having a range of 40%~79.9%, and the first-stage secondary warning is a range of 40%~52.9%, and the second-stage secondary warning is a range of 53%~65.9%, and the third-stage secondary warning is a range of 66%~79.9%.

Similarly, the secondary warnings of three stages are distributed within a range of torque value of 80%~95.9% in the mid-level warning interval, and these secondary warnings include the first-stage secondary warning being a range of 80~84.9%, the second-stage secondary warning being a range of 85%~89.9%, and the third-stage secondary warning being a range of 90%~95.9%.

In the high-level warning interval with a range over 96%, the secondary warnings of three stages are set, and these secondary warnings include the first-stage secondary warning being a range of 96%~99.9%, the second-stage secondary warning being a range of 100%~103.9%, and the third-stage secondary warning with a range over 104%.

Figure 4A:
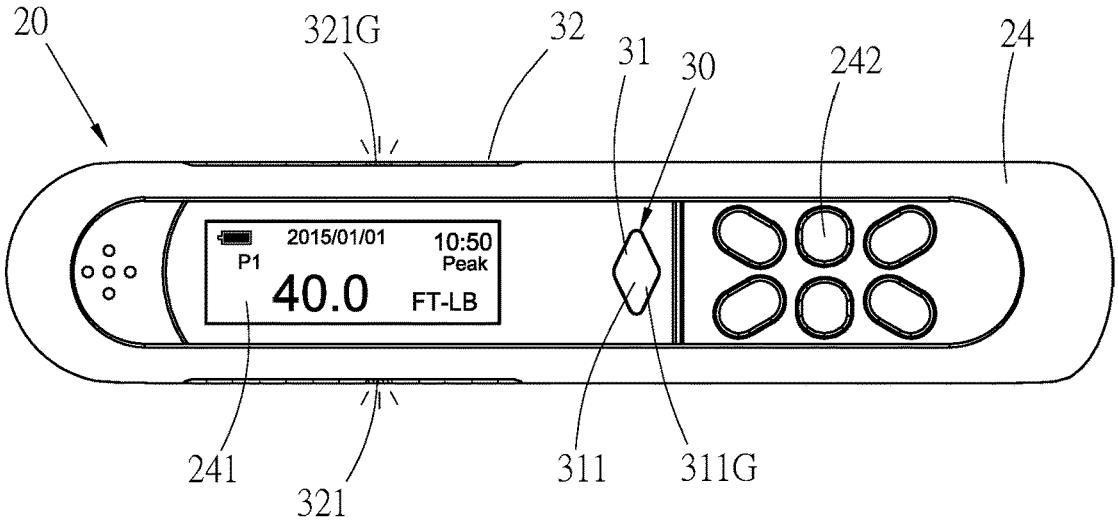
FIGS. 4A to 4C are schematic views showing the actions of a secondary warning unit when a primary warning unit shows a green light in accordance with a preferred embodiment of the present invention.
Figure 4B:
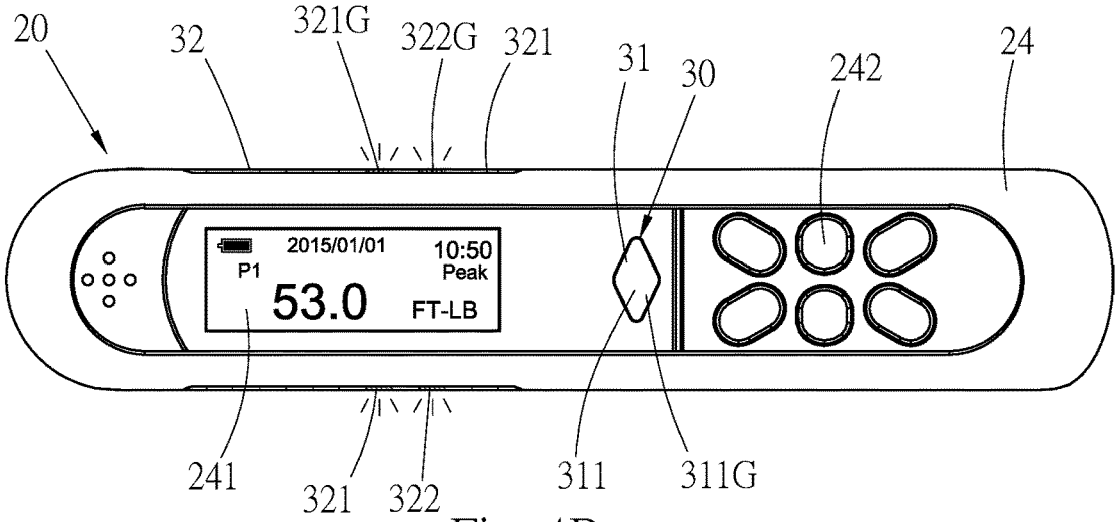
Figure 4C:
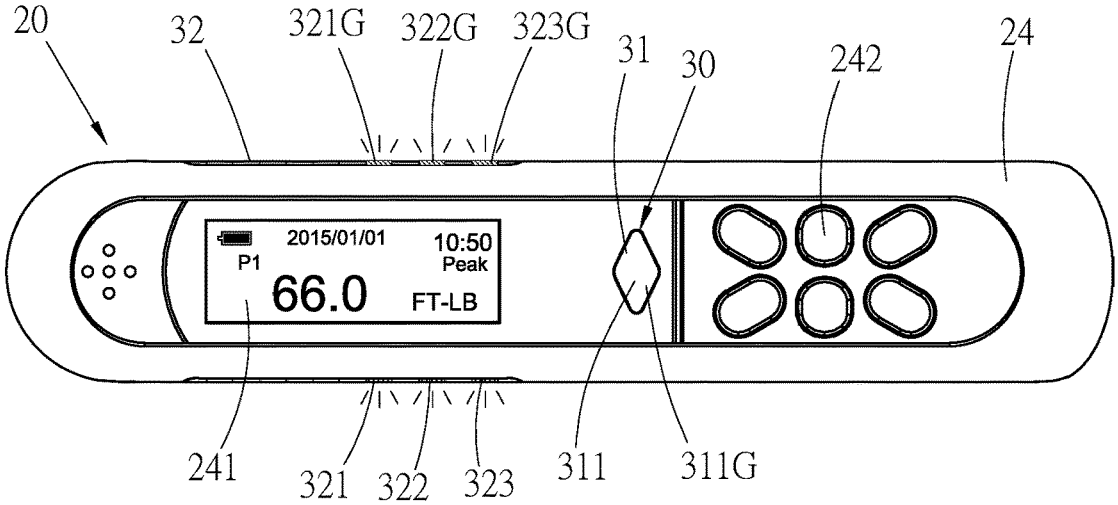

Wherein, the primary warning unit 31 is an illuminator 311, and the illuminator 311 will emit different colors corresponding to the three different warning intervals. Please refer to FIGS. 4 to 6, in this embodiment, the illuminator 311 will be green 311G in the low-level warning interval, yellow 311Y in the mid-level warning interval, and red 311R in the high-level warning interval, and the three different colors are displayed and provided for users to know about which warning interval the value of applied force is situated in. In practice, the range of the comparison value of each warning interval may be adjusted according to a fixed percentage or actual requirements.

Refer to FIGS. 3 to 6, there are three illuminators 321, 322 and 323 in each secondary warning unit 32 of this embodiment, and the three illuminators 321, 322, 323 of the secondary warning unit 32 are arranged sequentially in a direction from the tool head 21 to the rear of the tool body 20.

Refer to FIGS. 3 to 6, when the illuminator 311 of the primary warning unit 31 is in green 311G, the secondary warning units 32 will have the display of three green illuminators 321G, 322G and 323G. When the illuminator 311 of the primary warning unit 31 is in yellow 311Y, the secondary warning unit 32 will have the display of three yellow illuminators 321Y, 322Y and 323Y. When the illuminator 311 of the primary warning unit 31 is in red 311R, the secondary warning unit 32 will have the display of three red illuminators 321R, 322R, 323R.

Refer to FIGS. 3 and 4A to 4C, when the operation value (such as the torque value, the rotational angle, or the angle value measured after reaching the predetermined torque value) of the torque tool 10 falls within a range of the low-level warning interval (40%~79.9%) of the predetermined value, the display of the illuminator 311 of the primary warning unit 31 will be in green 311G. The quantity of lit illuminators of the secondary warning unit 32 increases with the increase of the comparison value. When the comparison value of the torque tool 10 falls within a range of 40%~52.9% the secondary warning unit 32 will light up the first green illuminator 321G to provide a first-stage secondary warning; when the comparison value of the torque tool 10 falls within a range of 53%~65.9%, the first green illuminator 321G of the secondary warning unit 32 will be lit continuously and the second green illuminator 322G will also be lit, the two green illuminators 321G, 322G will be lit simultaneously to define a second-stage secondary warning; and when the comparison value of the torque tool falls within a range of 66%~79.9%, the secondary warning unit 32 will light up the aforementioned two illuminators 321G, 322G, and the third green illuminator 323G will also be lit, and the three illuminators 321G, 322G and 323G will be lit to form a third-stage secondary warning.

Figure 5A:
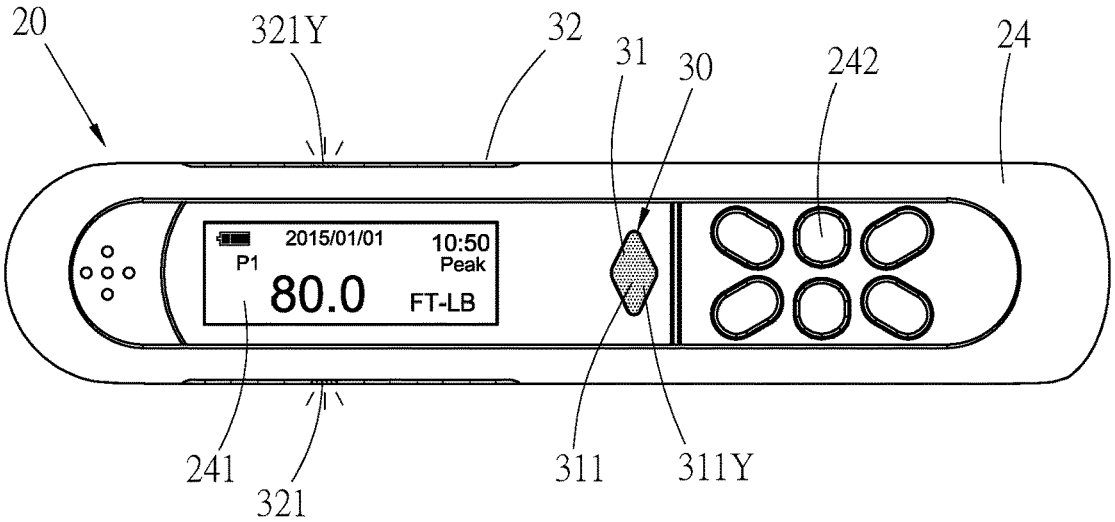
FIGS. 5A to 5C are schematic views showing the actions of a secondary warning unit when a primary warning unit shows a yellow light in accordance with a preferred embodiment of the present invention.
Figure 5B:
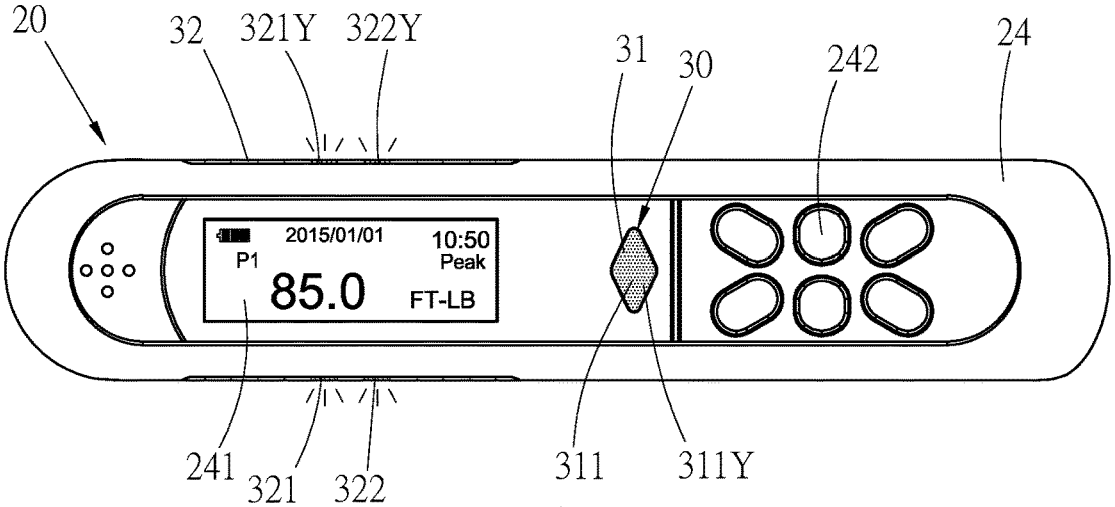
Figure 5C:
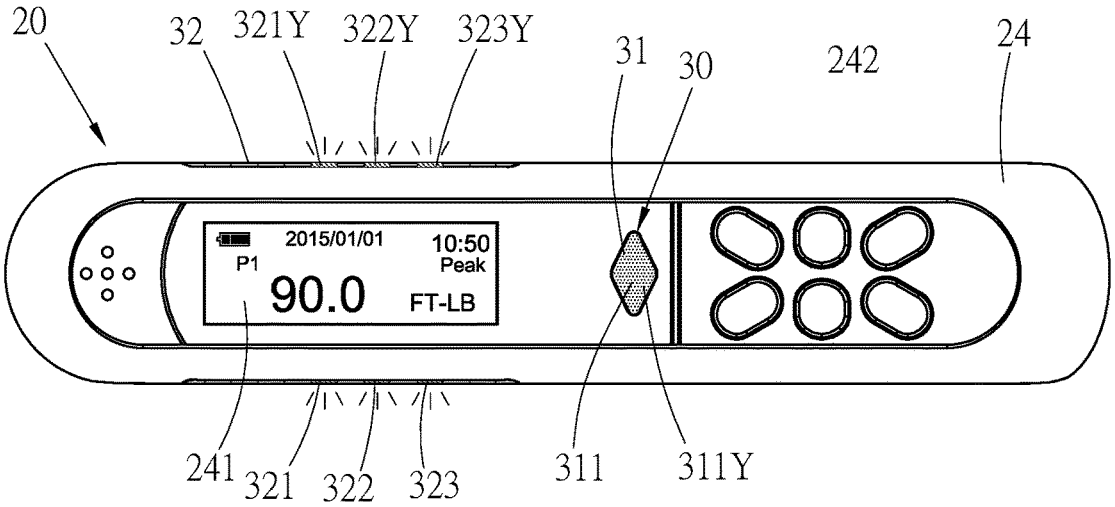

Please refer to FIGS. 5A to 5C, when the operation value (such as the torque or angle) of the torque tool 10 falls within a range of the mid-level warning interval (80%~95.9%) of the predetermined value, the display of the illuminator 311 of the primary warning unit 31 is in yellow 311Y, and the quantity of lit illuminators of the secondary warning unit 32 increases with the actual operation value. When the comparison value of the torque tool 10 falls within a range of 80%~84.9%, the secondary warning unit 32 will light up the first yellow illuminator 321Y to provide a first-stage secondary warning; when the comparison value of the torque tool 10 falls within a range of 85%~89.9%, the secondary warning unit 32 will keep the first yellow illuminator 321Y to be lit continuously and will light up the second yellow illuminator 322Y so that the two yellow illuminators 321Y, 322Y will be lit simultaneously to define a second-stage secondary warning; and when the comparison value of the torque tool 10 falls within a range of 90%~95.9%, the first yellow illuminator 321Y and the second yellow illuminator 322Y of the secondary warning unit 32 will continue to be lit, and the third yellow illuminator 323Y will also be lit, and the three yellow illuminators 321Y, 322Y and 323Y will be lit simultaneously to define a third-stage secondary warning.

Figure 6A:
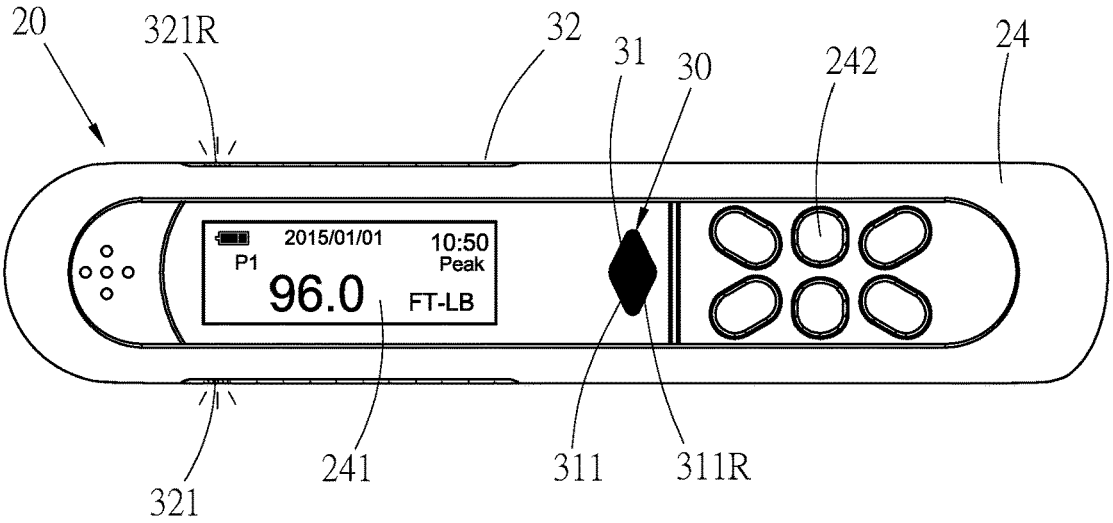
FIGS. 6A to 6C are schematic views showing the actions of a secondary warning unit when a primary warning unit shows a red light in accordance with a preferred embodiment of the present invention.
Figure 6B:
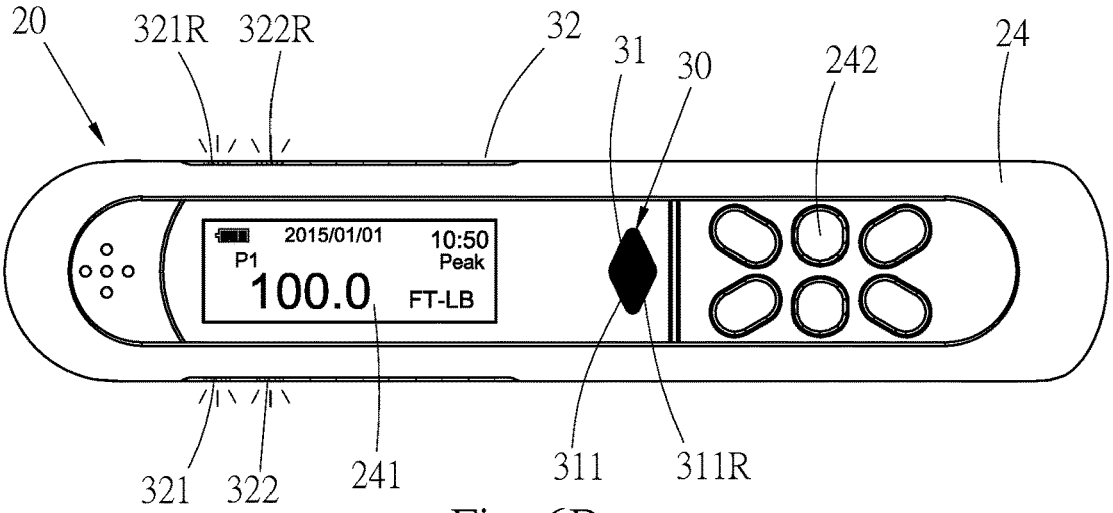
Figure 6C:
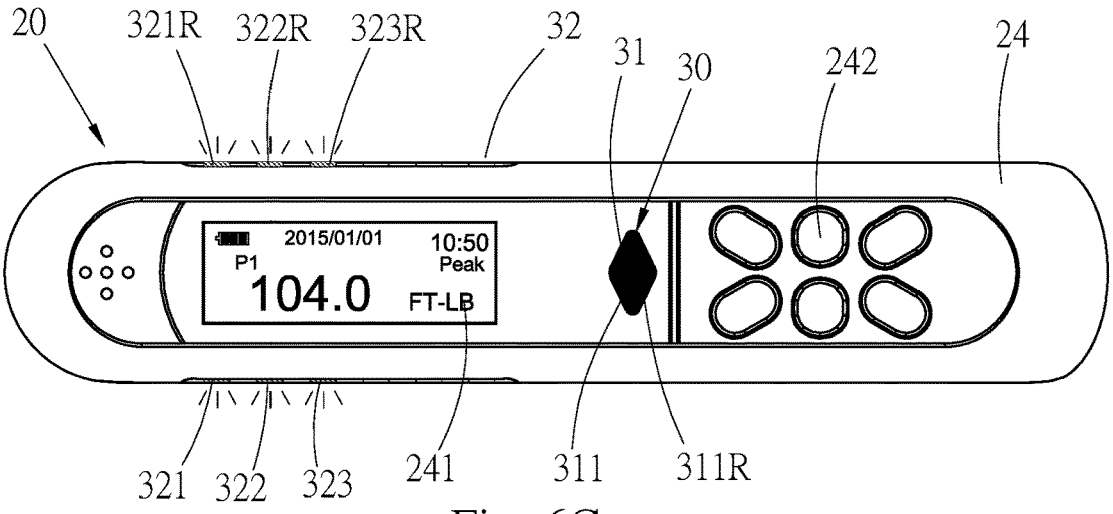

In FIGS. 6A to 6C, when the operation value (such as the torque or angle) of the torque tool 10 falls within a range of the high-level warning interval (96% or above) of the predetermined value, the display of the illuminator 311 of the primary warning unit 31 is in red 311R. The quantity of lit illuminators of the secondary warning unit 32 increases with the actual comparison value. When the comparison value of the torque tool 10 falls within a range of 96%~99.9%, the secondary warning unit 32 will light up the first red illuminator 321R to provide a first-stage secondary warning; when the comparison value of the torque tool 10 falls within a range of 100%~103.9%, the secondary warning unit 32 will keep the first red illuminator 321R to be lit continuously, and will also light up the second red illuminator 322R, so that the two red illuminators 321R, 322R will be lit simultaneously to define a second-stage secondary warning; and when the comparison value of the torque tool 10 is beyond 104%, the secondary warning unit 32 will keep the first red illuminator 321R and the second red illuminator 322R to be lit continuously, and will also light up the third red illuminator 323R, so that the three red illuminators 321R, 322R and 323R will be lit simultaneously to define a third-stage secondary warning.

When the secondary warning unit provides the first-stage to third-stage warnings, the three illuminators 321, 322, 323 are lit sequentially, and the illuminators 321, 322, 323 are lit in a direction from the tool head 21 to the rear of the tool body 20. In an embodiment, each stage of the secondary warning may be allocated uniformly with a numerical range of the warning interval. In the low-level warning interval and the mid-level warning interval of this preferred embodiment, the range of each secondary warning occupies approximately one-third of the warning interval range; or the warning interval is set with a predetermined range for the secondary warning. In the high-level warning interval of this embodiment, the range of each secondary warning is set up a proportion.

The primary warning unit 31 provides corresponding color illuminators 311 for the warning of different warning intervals, and the secondary warning unit 32 can display different quantity of illuminators 321, 322, 323 for the secondary warnings of different stages, so that the users can learn about the torque value or rotational angle of the applied force situating at what stage of the secondary warning of the warning interval and the user can clearly know about the magnitude of the comparison value between the operation torque value or angle and the predetermined value, and the secondary warning subdivides the warning interval into smaller ranges to indicate finer numerical value. Since there are only three illuminators 321, 322, 323 of the secondary warning unit 32, users can make the reading and determination quickly.

In practical application, there may be just one secondary warning unit 32, and the three different primary warning units 31 may use the same sets of illuminator 321, 322 and 323 of the secondary warning unit 32 to display the secondary warnings of three stages. As long as the secondary warning unit 32 can display the secondary warning of the three different stages formed by the warning intervals of the primary warning unit 31, the effects of the present invention can be achieved. The illuminator 321 of the secondary warning unit 32 in the same warning interval can also provide a change of different colors to provide the display of the secondary warnings of three stages, and form a different color change or a different flash frequency change in different stage of the secondary warnings.

In order to provide another warning effect to the users, the tool body 20 further comprises an auxiliary warning device (not shown in the figure) for receiving a signal of the processing unit 23. When the comparison value sensed by the sensing unit 22 has reached the predetermined value or the percentage is equal to 100%, the auxiliary warning device will be driven to provide another warning action, wherein the auxiliary warning device is a vibrator. When the sensed value such as the torque value or angle value sensed and measured by the sensing unit 22 is equal to the predetermined value, the auxiliary warning device will drive the vibrator to vibrate, so that the torque tool 10 not just provides a light warning by the warning assembly 30 only, but also produces another warning effect by vibration.

In addition, the processing unit 23 of the torque tool 10 may be set with an overload ratio, and the warning assembly 30 has an overload indication, and the overload ratio is a specific overload ratio of the sensed value of the sensing unit 22 to the predetermined value of the processing unit 23. When the comparison value between the sensed value and the predetermined value exceeds the overload ratio, the processing unit 23 will drive the warning assembly 30 to produce the overload indication and give warnings to the users. In this embodiment, the overload ratio is set to 104%. After the comparison value between the sensed value of the torque tool and the predetermined value has reached the overload ratio, the processing unit 23 will drive the warning assembly 30 to produce an overload indication. The overload indication produces a flashing state for the illuminator 311 of the primary warning unit 31 and the illuminators 321, 322, 323 of the secondary warning unit 32 to allow the users to know that the torque value of the applied force has exceeded the predetermined value, so that the users can stop applying force onto the torque tool 10.

In the torque tool 10 of the present invention, the operation value can be warned by the primary warning and the secondary warning of the warning assembly 30, the primary warning unit 31 provides a primary warning of the warning interval, and then the secondary warning unit 32 provides a detailed warning for the warning interval to let the users know about the relation between the applied force and the predetermined value quickly and accurately. Since the secondary warning unit 32 produces the secondary warnings with a small number of stages, therefore the users do not spend too much time to determine the torque value, and the user can know about the current operation situation quickly and accurately.

What is claimed is:

1. A torque tool with a segmented warning effect, comprising:

a tool body having a sensing unit for sensing an operation value of the torque tool to form a sensed value;

a processing unit for comparing the sensed value of the sensing unit with a predetermined value, and outputting a comparison value after comparing the sensed value with the predetermined value;

at least two warning intervals formed by the comparison value of at least two different numerical ranges;

a warning assembly having a primary warning unit and at least one secondary warning unit, the primary warning unit having at least two luminescent colors, the secondary warning unit having at least two illuminators;

wherein the warning assembly providing a warning in each warning interval by the primary warning unit together with the secondary warning unit, when the comparison value falls in one of the warning intervals, the primary warning unit emitting a corresponding color light; the secondary warning unit providing a secondary warning of at least two stages according to a change of the comparison value in the warning interval; and when the comparison value falls into a different warning interval, the primary warning unit emitting a different color light in each interval.

2. The torque tool as claimed in claim 1, wherein the primary warning unit includes three warning intervals which are a low-level warning interval, a mid-level warning interval, and a high-level warning interval represented by a first color light, a second color light, and a third color light respectively; and the secondary warning unit provides secondary warnings of three stages which include a first stage, a second stage and a third stage.

3. The torque tool as claimed in claim 1, wherein when the primary warning unit provides a warning light of any warning interval, the illuminator of the secondary warning unit has a luminescent color equal to or different from a luminescent color of the primary warning unit.

4. The torque tool as claimed in claim 2, wherein when the primary warning unit provides a warning light of any warning interval, the illuminator of the secondary warning unit has a luminescent color same as or different from the luminescent color of the primary warning unit.

5. The torque tool as claimed in claim 1, wherein the primary warning unit has three warning intervals for warning, and shows a percentage range of the comparison value, and a low-level warning interval has a percentage range of 40%~79.9%, and a mid-level warning interval has a percentage range of 80%~95.9% and a high-level warning interval has a percentage range greater than 96%.

6. The torque tool as claimed in claim 1, wherein the tool body has a tool head disposed at a front end thereof, and the illuminators of the secondary warning units have a lighting direction arranged in the order from the tool head towards a rear end of the tool body.

7. The torque tool as claimed in claim 1, wherein the warning assembly has an overload indication and also includes: an overload ratio which is a ratio of the overload percentage of the sensed value of the sensing unit to overload percentage of the predetermined value of the processing unit, and after the comparison value of the sensed value and the predetermined value has reached the overload ratio, the processing unit drives the primary warning unit or the secondary warning unit provides the overload indication.

8. The torque tool as claimed in claim 1, wherein the lighting quantity of the illuminator of the secondary warning unit increases with the increase of the comparison value.

9. The torque tool as claimed in claim 1, wherein the tool body has a front and two sides, and the primary warning unit is installed at the front of the tool body, and the at least one secondary warning unit is installed at the at least one side of the tool body.

10. The torque tool as claimed in claim 1, wherein the luminescent color of the illuminators of the secondary warning unit is same or different in different stages.

11. A torque tool with a segmented warning effect, comprising:

a tool body having a sensing unit for sensing an operation value of the torque tool to form a sensed value;

a processing unit for comparing the sensed value of the sensing unit with a predetermined value, and outputting a comparison value after comparing the sensed value with the predetermined value;

at least two warning intervals for indicating the comparison values of at least two different numerical ranges;

a warning assembly having a primary warning unit and at least one secondary warning unit;

the warning assembly providing a warning in each warning interval by the primary warning unit together with the secondary warning unit, when the comparison value falls into a different warning interval, the primary warning unit provides a corresponding warning, and the secondary warning unit provides the secondary warnings of at least two stages according to the change of the comparison value of the warning interval.

12. The torque tool as claimed in claim 11, wherein the primary warning unit has three warning intervals for warning, and shows a percentage range of the comparison value, and a low-level warning interval has a percentage range of 40%~79.9%, and a mid-level warning interval has a percentage range of 80%~95.9% and a high-level warning interval has a percentage range greater than 96%.

13. The torque tool as claimed in claim 11, wherein the warning assembly has an overload indication and also includes: an overload ratio which is a ratio of the overload percentage of the sensed value of the sensing unit to overload percentage of the predetermined value of the processing unit, and after the comparison value of the sensed value and the predetermined value has reached the overload ratio, the processing unit drives the primary warning unit or the secondary warning unit provides the overload indication.

* * * * *